US007500495B2

(12) United States Patent
Bruske et al.

(10) Patent No.: US 7,500,495 B2
(45) Date of Patent: Mar. 10, 2009

(54) END BINDER FOR A HEALD SHAFT

(75) Inventors: Johannes Bruske, Albstadt (DE); Stefan Drope, Albstadt (DE); Karl-Heinz Gesing, Raesfeld (DE); Stefan Danner, Bitz (DE)

(73) Assignee: Groz-Backert KG, Albstadt (DE)

( * ) Notice: Subject to any disclaimer, the term of this patent is extended or adjusted under 35 U.S.C. 154(b) by 135 days.

(21) Appl. No.: 11/474,335

(22) Filed: Jun. 26, 2006

(65) Prior Publication Data

US 2007/0006931 A1 Jan. 11, 2007

(30) Foreign Application Priority Data

Jun. 24, 2005 (DE) ..... 10 2005 029 700

(51) Int. Cl.
*D03C 9/06* (2006.01)
*D03C 9/00* (2006.01)
*D03C 13/00* (2006.01)

(52) U.S. Cl. ..... 139/87; 139/82; 139/83; 139/84; 139/55.1

(58) Field of Classification Search ..... 139/82–84, 139/91, 92, 93
See application file for complete search history.

(56) References Cited

U.S. PATENT DOCUMENTS

| | | | | |
|---|---|---|---|---|
| 3,106,942 A | | 10/1963 | Ray | |
| 3,335,759 A | * | 8/1967 | Koch | 139/91 |
| 4,022,252 A | | 5/1977 | Ogura | |
| 4,349,052 A | | 9/1982 | Yaji et al. | |
| 4,355,667 A | * | 10/1982 | Shimizu | 139/91 |
| 4,877,060 A | * | 10/1989 | Froment et al. | 139/82 |
| 5,249,605 A | * | 10/1993 | Graf | 139/91 |
| 5,297,589 A | * | 3/1994 | Baumann | 139/91 |
| 5,483,996 A | * | 1/1996 | Mettler | 139/91 |
| 5,887,629 A | * | 3/1999 | Mettler et al. | 139/91 |
| 6,926,042 B2 | * | 8/2005 | Scheiwe | 139/91 |
| 2002/0040736 A1 | | 4/2002 | Fumex | |

FOREIGN PATENT DOCUMENTS

| | | |
|---|---|---|
| CH | 643 310 | 5/1984 |
| DE | 44 03 923 | 7/1995 |
| DE | 4403923 | 7/1995 |
| EP | 0297003 | 12/1988 |
| FR | 1 284 238 | 2/1962 |
| JP | 2-68331 | 3/1990 |

* cited by examiner

*Primary Examiner*—Bobby H Muromoto, Jr.
(74) *Attorney, Agent, or Firm*—Fitch, Even, Tabin & Flannery; Norman N. Kunltz

(57) ABSTRACT

An end binder (5) for a heald shaft (1) is formed by a bent sheet metal member (9) which preferably has a U-shaped cross section and which, according to the preferred embodiment, is of high-grade steel. The open side of the U-section faces the shaft rods (2,3). In the hollow space enclosed by the bent sheet metal member (9) shaft rod couplers (28) are secured which are preferably pivotally held. The upper or lower end of the bent sheet metal member forms part of a driving coupler (25) which is situated preferably in a linear continuation of the bent sheet metal member (9) and is a one-piece component with the end binder (5). Such a structure may be manufactured in a simple manner with very small tolerances, and it has a low weight, a substantial stiffness and highly satisfactory bearing properties for being supported in plastic guides.

16 Claims, 4 Drawing Sheets

END BINDER FOR A HEALD SHAFT

CROSS REFERENCE TO RELATED APPLICATION

This application claims the priority of German Patent Application No. 10 2005 029 700.5-26, filed on Jun. 24, 2005, the subject matter of which, in its entirety, is incorporated herein by reference.

BACKGROUND OF THE INVENTION

The invention relates to an end binder for a heald shaft.

Heald shafts are essential components of weaving machines. The heald shafts serve for shed-forming in which warp threads are guided from the warp thread assembly upward or downward, while others remain in a position of rest or are moved in an opposite direction. A weft thread is then introduced into the shed formed in this manner for obtaining the desired weave.

U.S. Pat. No. 4,022,252 discloses a heald shaft of the above-outlined type. It comprises an upper and a lower shaft rod which are horizontally oriented in use. Each shaft rod is provided with a shaft stave which supports the healds. Each heald has at least one yarn eyelet through which the warp yarn runs. At their ends the shaft rods are interconnected by end binders which are oriented vertically in use and which define a rectangular frame with the shaft rods. The end binders hold the shaft rods at a defined distance from one another and also assume guiding tasks.

The end binder known from the U.S. Pat. No. 4,022,252 comprises a plastic section body in which a cross-sectionally U-shaped sheet metal section is formed. A portion of the sheet metal section is freely exposed at the side facing away from the shaft rods and serves as a guiding section for a vertical sliding guide of the heald shaft. The material pair plastic/steel may be critical. Measures must be taken for preventing a separation of the metal section from the plastic body.

Japanese Patent Document No. 02068331 A discloses a light-weight heald shaft which includes an end binder formed of a combination of several layers of laminated thermoplastic materials and aluminum layers.

European Patent No. EP 0 297 003 B1 describes in FIG. 8 an end binder which is a thick-walled U-section and in which the section is open at the side facing away from the shaft rods. Such sections may be manufactured from aluminum in a milling or extrusion process.

German Patent No. 44 03 923 C1 discloses a tubular, box-section like end binder which is connected with the shaft rod of a heald shaft by corner joints. For driving the heald shaft, it is proposed that the corner joints include a driven part attached by rivets.

United States Published Patent Application No. 2002/004 0736 A1 discloses a solid-section end binder for a heald shaft. The end binder serves not only for holding and supporting the shaft rods, but also for driving the same. For this purpose the end binder is, at its side facing away from the shaft rods, provided with a groove receiving an endwise threaded bar. To the upper end of the end binder two plates are screwed which have a receiving slot for a coupling member which is screwed together with the threaded bar. The coupling member may be vertically displaceably guided on a guiding section to provide guidance for the heald shaft.

The slotted plates which are provided for attaching the end binder with the coupling member and the threaded bar, are screwed together with the solid section.

The manufacture of the above-described end binders involve substantial outlay and furthermore, their load-bearing capacity is limited.

It is therefore an object of the invention to provide an improved end binder.

SUMMARY OF THE INVENTION

The above object is achieved with the end binder as defined in claim 1.

The end binder according to the invention has a basic body which is a bent sheet metal section that may be formed of a single bent sheet metal member or, if required, of several (for example two) bent sheet metal members. The bent sheet metal member is a hollow section which surrounds a hollow space where, if required, necessary components may be accommodated. It is also feasible to entirely or partially fill the hollow space with a foam or a honeycomb structure. In the preferred embodiment, however, a filling is dispensed with. The bent sheet metal member assumes the carrying function; it connects with one another the upper and lower shaft rods or the shaft rod couplers provided for attaching the shaft rods.

In the manufacture of the bent sheet metal member punching and bending operations may be utilized which signify substantial cost saving as compared to previously used milling processes. Further, the end binders according to the invention may be made with simple means more accurately than the conventional end binders which always have a certain bending elasticity and therefore have to be aligned after manufacture. In case of bent sheet metal members, such as end binders made by a punching process, tolerances concerning their effective length may be in the order of magnitude of ±0.02 mm. This represents a significant progress as compared to conventional end binders.

The hollow space provided in the end binder extends preferably at least along a substantial portion of the length direction of the bent sheet metal member. Such a portion is given, for example, by the distance between the shaft rod couplers. A large degree of stiffness and a low weight of the end binders are obtained which makes possible not only the above-mentioned cost reduction in the manufacture, but also in some instances result in an improvement of the operating speed of the weaving machine, whose heald shafts are provided with such end binders.

The bent sheet metal member forming the basic body of the end binder may be a U-section and may be a one-piece component. At its side facing the shaft rods, the bent sheet metal member may be provided with an open slot, from which may project the shaft rod couplers or other elements which, for example, need to contact the healds, such as spacers or the like. The positioning and mounting of such additional elements are simple and may be effected at different required locations by means of the long, open hollow space accessible through an additional slot. In this manner end binders having different distances between the two shaft rods may be manufactured in a simple manner.

The end binder may be prepared for connection with the shaft rod coupler at different spaced locations. In this manner it is feasible to set different shaft rod distances and thus different heald plays.

The hollow space is preferably closed at the outer side of the end binder. The outer surface of the end binder may then serve as a slide way. Further, risk of injury and tendency to soiling are reduced.

If required, the basic body may also be a partially closed bent sheet metal member which is an U-section where the edges of its legs have portions bent toward one another. Such an end binder has been proven to be particularly kink-resistant.

The basic body of the end binder may also be formed from two (or more) interconnected bent sheet metal members. They are, for example, shell-shaped parts facing one another at their open sides. In this manner a closed end binder is obtained which surrounds a hollow space, while the end surfaces have openings. For mounting the shaft rod couplers, respective recesses are provided through which the shaft rod couplers project. The shell sections may be welded or riveted to one another.

According to a preferred embodiment a driving coupler is provided on the end binder. The driving coupler may be formed by two mutually surface-parallel, flat projections which join the basic body preferably in a seamless and jointless manner, that is, they constitute a one-piece component therewith. The jointless and seamless attachment is obtained by punching out the projections as a single piece with the basic body or otherwise cutting them out from sheet metal. If required, they may be welded together in which case a weld seam is obtained.

Between the end binders a coupling member may be held which serves for transmitting a driving motion to the end binder. The coupling member is preferably held captive on the projections and may be supported thereon, for example, for pivotal motion. The coupling member is preferably hexagonal.

The bent sheet metal member (or bent sheet metal members) is preferably made of steel. It may run in plastic guides; as a rule, steel and plastic represent a good pairing of material. Stainless steel is preferred, so that surface treatment, particularly measures for protection against corrosion may be dispensed with.

Further details of advantageous embodiments of the invention form subjects of the drawing, the description or the claims. Embodiments of the invention are illustrated in the drawings.

DETAILED DESCRIPTION OF THE INVENTION

Figure 1:
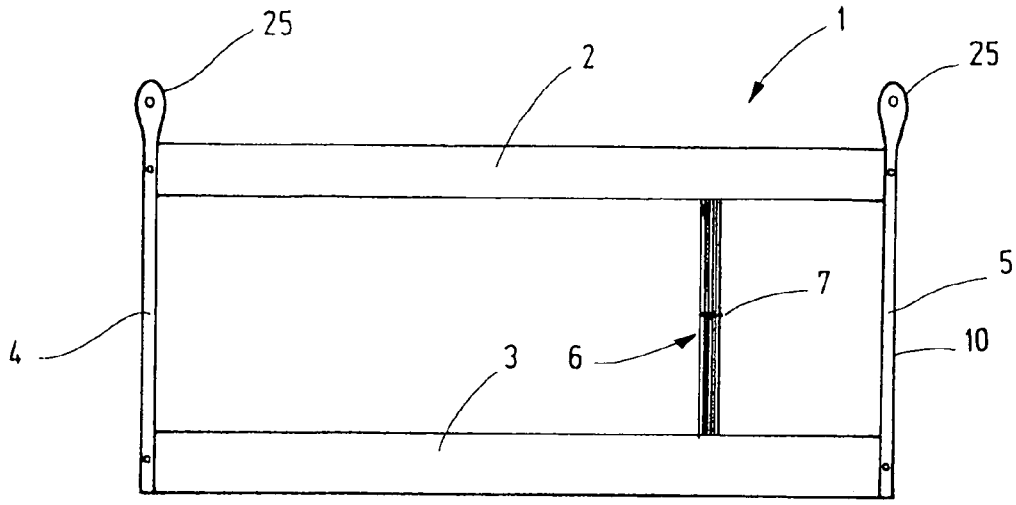
FIG. 1 is a schematic illustration of a heald shaft.

FIG. 1 illustrates a heald shaft 1 having upper and lower shaft rods 2, 3 and end binders 4, 5. The shaft rods 2, 3 and the end binders 4, 5 form a rectangular frame. To the upper and lower shaft rods respective shaft staves are secured which support healds 6 provided with yarn eyelets 7 for guiding the warp yarns.

The end binders 4, 5 are of identical structure and are arranged preferably in a mirror-image symmetry. The description of the end binder 5 which follows, also applies to the end binder 4. It is also feasible to structure the end binders differently, so that, for example, one of the end binders is unreleasibly attached to the shaft rods, while the other end binder is releasably connected therewith.

Figure 2:
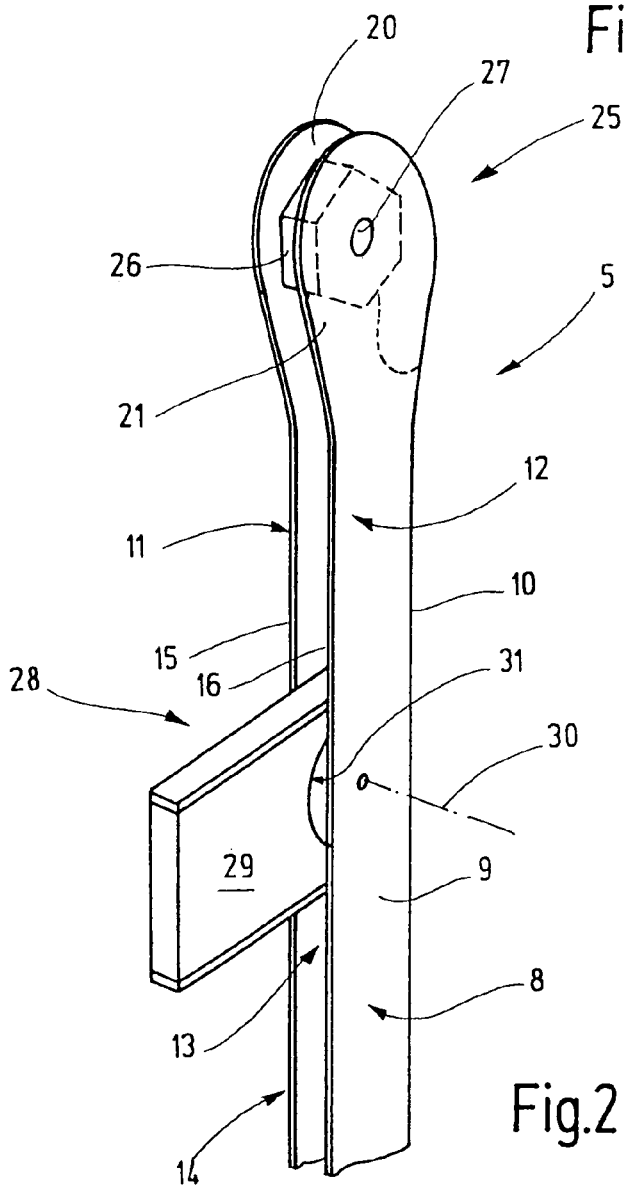
FIG. 2 is a fragmentary perspective view of an end binder shown with a shaft rod coupler and a driving coupler.

FIG. 2 illustrates the end binder 5 which comprises a basic body 8 made of a bent sheet metal member 9 consisting preferably of a thin steel sheet metal, preferably of high-grade steel. The bent sheet metal member 9 is an elongated linear bar which is essentially vertically oriented in use and has a preferably closed back 10 and essentially planar flat sides 11, 12. The linear bar surrounds a hollow space 13 which extends along the entire length of the end binder 5 of the presently described embodiment. The hollow space 13 is accessible toward the shaft rods 2, 3 through a wide slot 14 which is defined between the lateral legs or portions 15, 16 (defined by the flat sides 11, 12) of the bent sheet metal member 9. It required, the hollow space 13 may be filled with a light material, such as a foam, a honeycomb structure or the like for preventing accumulation of dirt in the hollow space 13. The hollow space 13, however, is preferably substantially empty.

Figure 8:
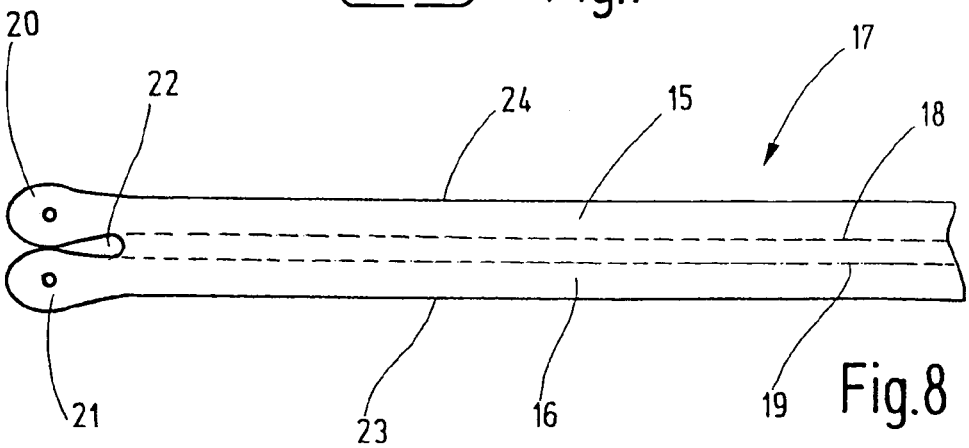
FIG. 8 shows a blank for the end binder according to FIG. 2.
Figure 9:
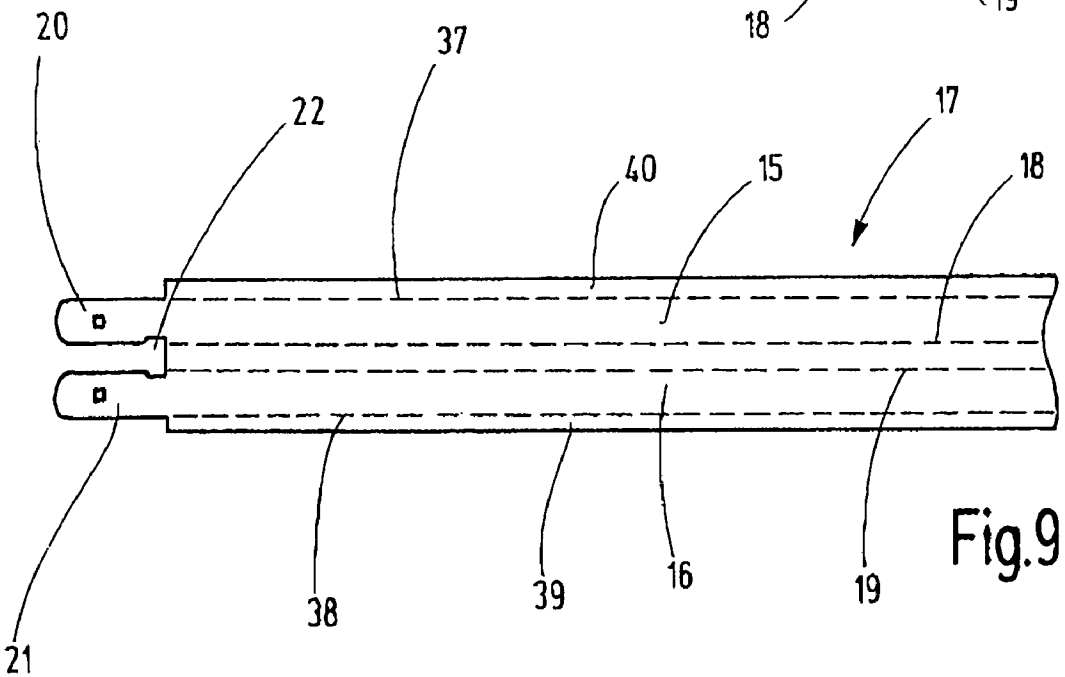
FIG. 9 shows a modified embodiment of a blank for the end binder according to FIG. 2.

The bent sheet metal member 9 is preferably a one-piece component bent from a blank. Such a blank 17, which is shown in FIGS. 8 and 9, is bent along the bending lines 18, 19 (shown in dash lines) into a U-section which then constitutes the basic body 8 of the end binder 5. Other section shapes, such as U-sections with an inwardly arcuate back, H-sections or others may be utilized as well. The blank 17 includes projections 20, 21, between which, for separating the same, preferably a recess 22 is provided. The blank 17 is bordered by parallel edges 23, 24, with which the bending lines 18, 19 are in a parallel relationship. The bending lines 18, 19 adjoin the recess 22. As the blank 17 is bent at right angles about the bending lines 18, 19, a U-section is obtained which has mutually parallel-held projections 20, 21 and mutually parallel legs 15, 16.

Figure 10:
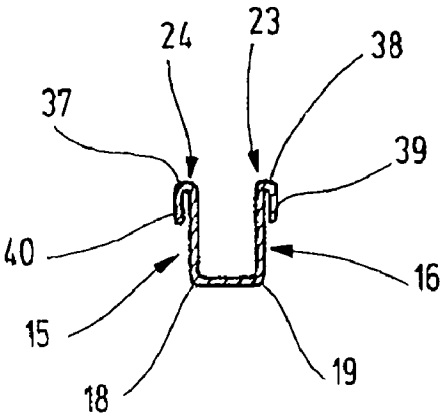
FIG. 10 is a fragmentary view of a cross section for an end binder according to FIG. 9, shown on a different scale.

Another embodiment shown in FIG. 9 has further bending lines 37, 38. The portions 39, 40 are, in the manufacture of the U-shaped bent sheet metal member 9, bent around about 180°, so that they will lie parallel to the legs 18, 19 of the bent sheet metal member 9 on the outer sides thereof (FIG. 10) or are held at a small distance from the outer side. In this manner rounded, burr-free edges 23, 24 are obtained. The projections are in a linear continuation of the edges 23, 24 or the bending lines 18, 19. The edges of the projections 20, 21 do not extend beyond the bending lines relative to a transverse direction oriented perpendicularly to the bottom of the U-section. The recess 22 has at its end an enlargement with rounded corners, so that during the manufacture of the bent sheet metal member 9 no fissures of material occur in that region.

The projections 20, 21 form a driving coupler 25 by means of which the end binder 5 is vertically reciprocated. The driving coupler 25 may include a coupling section 26 which is held, for example, between the projections 20, 21 and which may be, for example, a hexagonal section body constituting a coupling half which fits to another coupling half attached to the driving device. The coupling section joins the projections 20, 21, for example, by a hollow pin 27 which is in a linear continuation of a central axis of the basic body 8. The central axis is considered to be the line which passes through the surface center of gravity of the bent sheet metal member 9.

Figure 3:
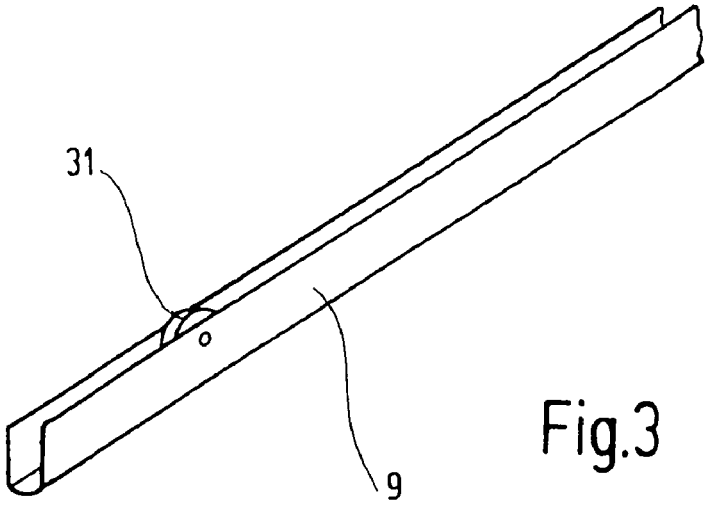
FIG. 3 is a fragmentary, schematic perspective view of the end binder shown in FIG. 2, illustrated on a different scale.
Figure 5:
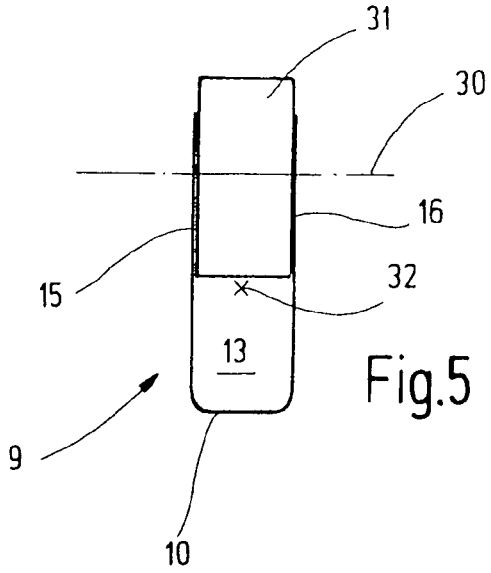
FIGS. 5-7 are schematic sectional views of different end binder sections.

The end binder 5 further has a shaft rod coupler 28 projecting from the hollow space 13. The shaft rod coupler 28 has a coupling member 29 arranged for extending into, and secured within, a hollow space formed in the shaft rod 2 or 3. The coupling member 29 is supported on the end binder 5 for a limited pivotal motion preferably about a hinge axis 30 extending transversely to the end binder 5. The hinge axis 30 is defined in this embodiment by a cylindrical bearing member 31 on which the coupling member 29 is pivotally supported. The axis 30 lies preferably at least in the vicinity of the central axis of the end binder 5, but preferably at least within the outline defined by the cross section of the bent sheet metal member 9. As illustrated in FIGS. 2 and 3, the bearing member 31 may project from the hollow space 13. FIG. 5 shows the position of the central axis 32 relative to the axis 30 of the bearing member 31 which is non-rotatably held between the legs 15, 16. Its cylindrical outer surface may serve as a bearing surface.

The end binder 5 has shaft rod couplers at its upper end as shown in FIGS. 1 and 2, as well as at its lower end. The shaft rod couplers are joined by the shaft rods 2, 3, whereby a releasable, yet dynamically firm attachment is established. This results in the rectangular frame illustrated in FIG. 1. The frame may be slightly deformed similarly to a parallelogram by virtue of the limited pivotal mobility of the coupling members 29. The heald shaft 1 is driven by the driving couplers 25 at the upper and lower ends of each end binder 4, 5.

In the manufacture of the end binder 5 first the blank 17 partially seen in FIG. 8 is made and bent along the bending lines 18, 19. Thereafter the couplers 25, 28 are mounted, whereby the making of the end binder 5 is essentially completed. It is preferably of thin, high-grade steel sheet metal. All operationally essential forces are transmitted by the bent sheet metal member 9. The latter transmits the driving motion from the driving coupler 25 to the shaft rod couplers 28. Any additional parts accommodated in the hollow space 13 have no functions in this respect.

Figure 4:
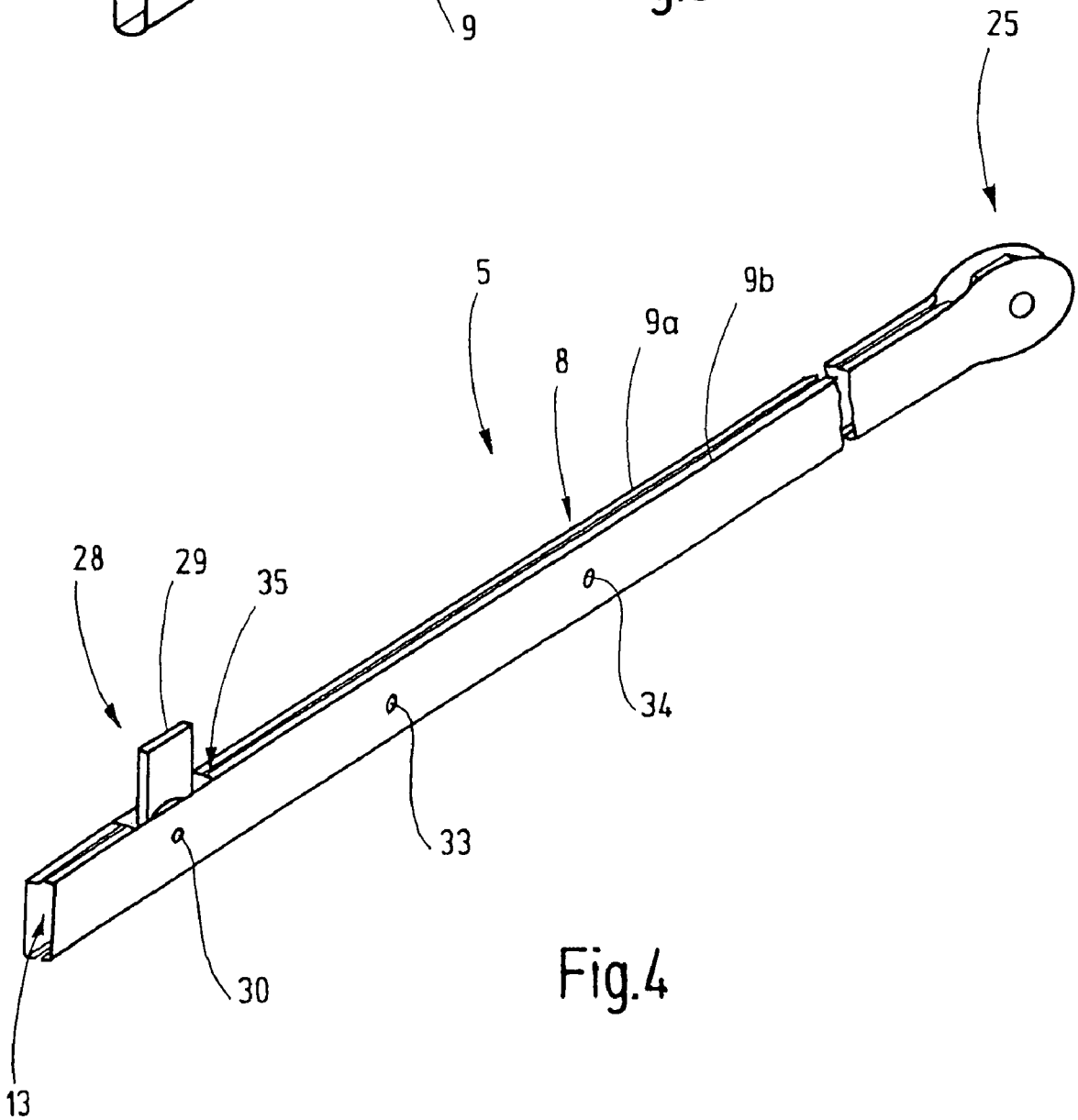
FIG. 4 is fragmentary perspective view of a modified embodiment of an end binder for the heald shaft illustrated in FIG. 1.
Figure 7:
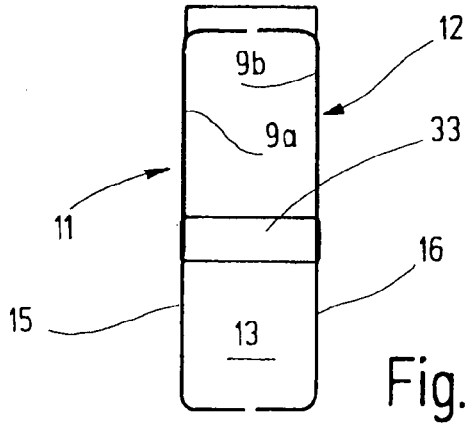

FIG. 4 shows a modified embodiment of an end binder 5, whose basic body 8 has two bent sheet metal members 9*a*, 9*b* which are flat, linear, bar-like U-sections, jointly surrounding the hollow space 13. The two shell-like bent sheet metal members 9*a*, 9*b* are individually manufactured and may be attached to, and held at a distance from, one another by rivets 33, 34. FIG. 7 illustrates the cross section of the bent sheet metal member 9*a*, 9*b*. The bent sheet metal members 9*a*, 9*b* each have a flat portion 15, 16 which, at the outside, define the flat sides 11, 12. The respective two edges of the portions 15, 16 are angled off at 90° which lends the bent sheet metal member 9*a*, 9*b* the required stiffness. In the region of the shaft rod coupler 28 the edges are provided with cutouts and the thus-obtained opening 35 provides a passage for the coupling member 29. The latter is, as described earlier, secured for pivotal motion about the axis 30. In other respects the description in conjunction with FIGS. 1, 2, 5 and 8 applies.

In a modification of the embodiment according to FIG. 4, the rivets 33 (34) may be dispensed with if the edges of the bent sheet metal members 9*a*, 9*b* which are bent toward one another, are welded together.

Figure 6:
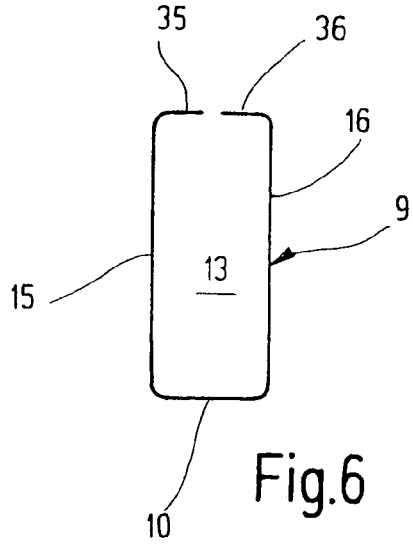

FIG. 6 shows a further embodiment of a bent sheet metal member 9 for an end binder 5. This embodiment is based on a U-section having parallel legs 15, 16 extending perpendicularly from the section back 10. As a departure from the U-section of FIG. 5, the legs 15, 16 are, at their free ends remote from the back 10, angled to one another. The edges bent toward one another may together define a slot. It is, however feasible to provide that the edges are in an abutting relationship with one another. At the location of abutment a weld seam may be provided to thus obtain a closed tubular section. In any event, the tubular section surrounds a hollow space 13 in which at least one shaft rod coupler 28 may be held.

As a modification of the structure shown in FIG. 6, the edges 35, 36 may be bent inward to lie on the inner surfaces of the legs 15, 16.

According to a further, non-illustrated embodiment, the end binder 5 is tubular and encloses a hollow space 13 in a gap-free manner. It is also feasible to provide the end binders both at their upper and lower ends with a driving coupler. The upper driving couplers may differ in structure from the lower driving couplers which provides for the possibility to drive the heald shaft with different driving systems.

An end binder 5 for a heald shaft 1 is formed by a bent sheet metal member 9 which preferably has a U-shaped cross section and which, according to the preferred embodiment, is of high-grade steel. The open side of the U-section faces the shaft rods 2, 3. In the hollow space enclosed by the bent sheet metal member 9 shaft rod couplers 28 are secured which are preferably pivotally held. The upper or lower end of the bent sheet metal member forms part of a driving coupler 25 which is situated preferably in a linear continuation of the bent sheet metal member 9 and is a one-piece component with the end binder 5. Such a structure may be manufactured in a simple manner with very small tolerances, and it has a low weight, a substantial stiffness and highly satisfactory bearing properties for being supported in plastic guides.

LIST OF REFERENCE CHARACTERS

1 heald shaft
2, 3 shaft rod
4, 5 end binders
6 healds
7 yarn eyelet
8 basic body
9, 9*a*, 9*b* bent sheet metal member
10 back
11, 12 flat sides
13 hollow space
14 slot
15, 16 leg/portion
17 blank
18, 19, 37, 38 bending lines
20, 21 projections
22 recess
23, 24 edges
25 driving coupler
26 coupling section
27 hollow pin
28 shaft rod coupler
29 coupling member
30 axis
31 bearing member
32 central axis
33, 34 rivets
35, 36 edges

The invention claimed is:

1. An end binder for a heald shaft of a weaving machine, comprising a basic body which is formed of at least one elongated bent sheet metal member having a U-shaped cross section extending along its entire length, which is essentially vertically oriented in use and which encloses a hollow space; and wherein: the basic body is provided with at least one shaft rod coupler which serves for joining a shaft rod of a heald shaft; the shaft rod coupler defines a side designated as an inner side of the end binder and facing toward a shaft rod, and further defines a side designated as an outer side of the end binder and facing away from a shaft rod; the hollow space of the basic body is open at the entire length of the inner side; and the shaft rod coupler extends out of the U-shaped basic body on the open inner side and is pivotally coupled to the basic body.

2. The end binder as defined in claim 1, wherein the end binder is prepared for connection with the shaft rod coupler at several locations spaced from one another.

3. The end binder as defined in claim 1, wherein the hollow space of the basic body is closed at the outer side, that is, at its back.

4. The end binder as defined in claim 1, wherein the basic body is formed of a single bent sheet metal member.

5. The end binder as defined in claim 1, wherein the U-shaped cross section comprises legs, each provided with an angled or bent edge.

6. The end binder as defined in claim 5, wherein the edges are bent toward those sides of the U-shaped cross section which are facing away from one another.

7. The end binder as defined in claim 1, wherein the basic body is formed of two bent sheet metal members attached to one another.

8. The end binder as defined in claim 7, wherein the bent sheet metal members are shell sections.

9. The end binder as defined in claim 8, wherein the shell sections are, at the edges facing one another, held at a distance from one another by connecting means or are held in an abutting relationship or are attached to one another.

10. The end binder as defined in claim 1, wherein the basic body is, at one of its ends, provided with a driving coupler.

11. The end binder as defined in claim 10, wherein the driving coupler is formed of two, mutually surface-parallel flat projections which are an integral part of the sheet metal member and join the basic body in a seamless and jointless manner and which thus form a one-piece component therewith.

12. The end binder as defined in claim 11, wherein the projections extend away from the basic body in its linear continuation.

13. The end binder as defined in claim 11, wherein a coupling section member is held between the projections.

14. The end binder as defined in claim 13, wherein the coupling section member is rotatably held.

15. The end binder as defined in claim 1, wherein the bent sheet metal member is steel.

16. A heald shaft comprising at least one end binder according to claim 1.

* * * * *